US006821193B2

(12) United States Patent
Kaye

(10) Patent No.: US 6,821,193 B2
(45) Date of Patent: Nov. 23, 2004

(54) MATERIAL POSITIONING AND SHAPING SYSTEM APPARATUS

(76) Inventor: Roger Kaye, 471 Clayhill Rd., Fort Ann, NY (US) 12877

( * ) Notice: Subject to any disclaimer, the term of this patent is extended or adjusted under 35 U.S.C. 154(b) by 0 days.

(21) Appl. No.: 10/108,689

(22) Filed: Mar. 27, 2002

(65) Prior Publication Data

US 2003/0186637 A1 Oct. 2, 2003

(51) Int. Cl.[7] ..... B24B 47/02; B24B 41/06

(52) U.S. Cl. ..... 451/332; 451/387; 451/404; 451/438; 451/394

(58) Field of Search ..... 451/331–332, 451/334, 365, 380, 384–385, 438, 394, 387, 397, 403–405, 210, 212–215, 221, 242, 246

(56) References Cited

U.S. PATENT DOCUMENTS 3,811,229 A 5/1974 Montgomery
3,811,230 A * 5/1974 Beck ..... 451/281
3,818,641 A 6/1974 Long
3,863,402 A 2/1975 Price
3,881,888 A 5/1975 Schwab
4,050,198 A 9/1977 Hales et al.
4,157,635 A * 6/1979 Ward ..... 451/220
4,259,814 A 4/1981 Glaser et al.
4,263,753 A * 4/1981 Imahashi ..... 451/389
4,363,193 A * 12/1982 Herzig ..... 451/140
4,602,531 A 7/1986 Korhonen
4,789,146 A 12/1988 Kuei
4,841,678 A 6/1989 Thomas
5,058,324 A 10/1991 Snellen, deceased
5,097,634 A * 3/1992 Hulme ..... 451/18
5,480,343 A 1/1996 Pedersen et al.
5,558,564 A 9/1996 Ascalon
5,667,427 A 9/1997 Airhart et al.
5,775,180 A * 7/1998 Parke ..... 76/85
5,941,763 A * 8/1999 Kaye ..... 451/278

* cited by examiner

*Primary Examiner*—Hadi Shakeri
(74) *Attorney, Agent, or Firm*—Schmeiser, Olsen & Watts

(57) ABSTRACT

An apparatus, system, and method thereof for material positioning and shaping. The apparatus includes a two-section positioning system which includes a guide and follower thereon for positioning along a path.

34 Claims, 10 Drawing Sheets

MATERIAL POSITIONING AND SHAPING SYSTEM APPARATUS

FIELD OF INVENTION

The present invention relates to generally a material shaping and positioning apparatus, material positioning and shaping system, and method, for use in shaping of materials such as for cutting gems, grinding or sharpening tools, and grinding lenses.

BACKGROUND OF INVENTION

Currently, when a workpiece (e.g., a lens, a scissors, a gem, a cuticle cutter, etc.) is positioned precisely for material shaping (e.g., sharpening, faceting, cutting, grinding, making, manufacturing, etc.) it is inaccurate and slow to both precisely position the workpiece in a general manner for work thereon, and to then precisely move and position the material workpiece symmetrically about various axes of rotation for further material shaping. Additionally, precise shaping of materials, such as gem faceting or the copying of gem facets from an existing gem to a new gem, is currently tedious and not readily possible when attempting to facet a gem with an odd number of faces.

Accordingly, there is a need for an improved device, system, and method of positioning and shaping of materials.

SUMMARY OF INVENTION

The present invention provides an apparatus, positioning system and method for positioning and shaping materials. One can position and shape materials using the invention for activities such as cutting gems, grinding or sharpening tools, and grinding lenses.

A first general aspect of the invention provides an apparatus comprising:

a positioning head for a material forming device, said positioning head having a first section and a second section, wherein at least one of said first section and said second section includes at least one depression for rotatable positioning along a path.

A second general aspect of the invention provides an apparatus comprising:

a material forming device;

a positioning head, operatively positioned with respect to said material forming device, said positioning head having a first section and a second section, wherein at least one of said first section and said second section includes at least one depression for rotatable positioning along a path.

A third general aspect of the invention provides an apparatus comprising:

a first section, including a guide; and a second section, including a follower, wherein said follower is operatively connected to said guide, and wherein the position of said second section, relative to said first section, is dependent upon the position of said follower relative to said guide.

A fourth general aspect of the invention provides an apparatus comprising:

a material shaping device; and a positioning system operatively attached to said material shaping device, said positioning system comprising a first section, including a guide, and a second section, including a follower, wherein said follower is operatively connected to said guide, and wherein the position of said second section, relative to said first section, is dependent upon the position of said follower relative to said guide, further wherein said positioning system has at least four degrees of freedom.

A fifth general aspect of the invention provides a method comprising:

providing a positioning head having a first section and a second section;

rotating at least one of the first section and second section with respect to each other along a path, wherein said path includes a depression.

The foregoing and other features of the invention will be apparent from the following more particular description of various embodiments of the invention.

BRIEF DESCRIPTION OF DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

Figure 1:
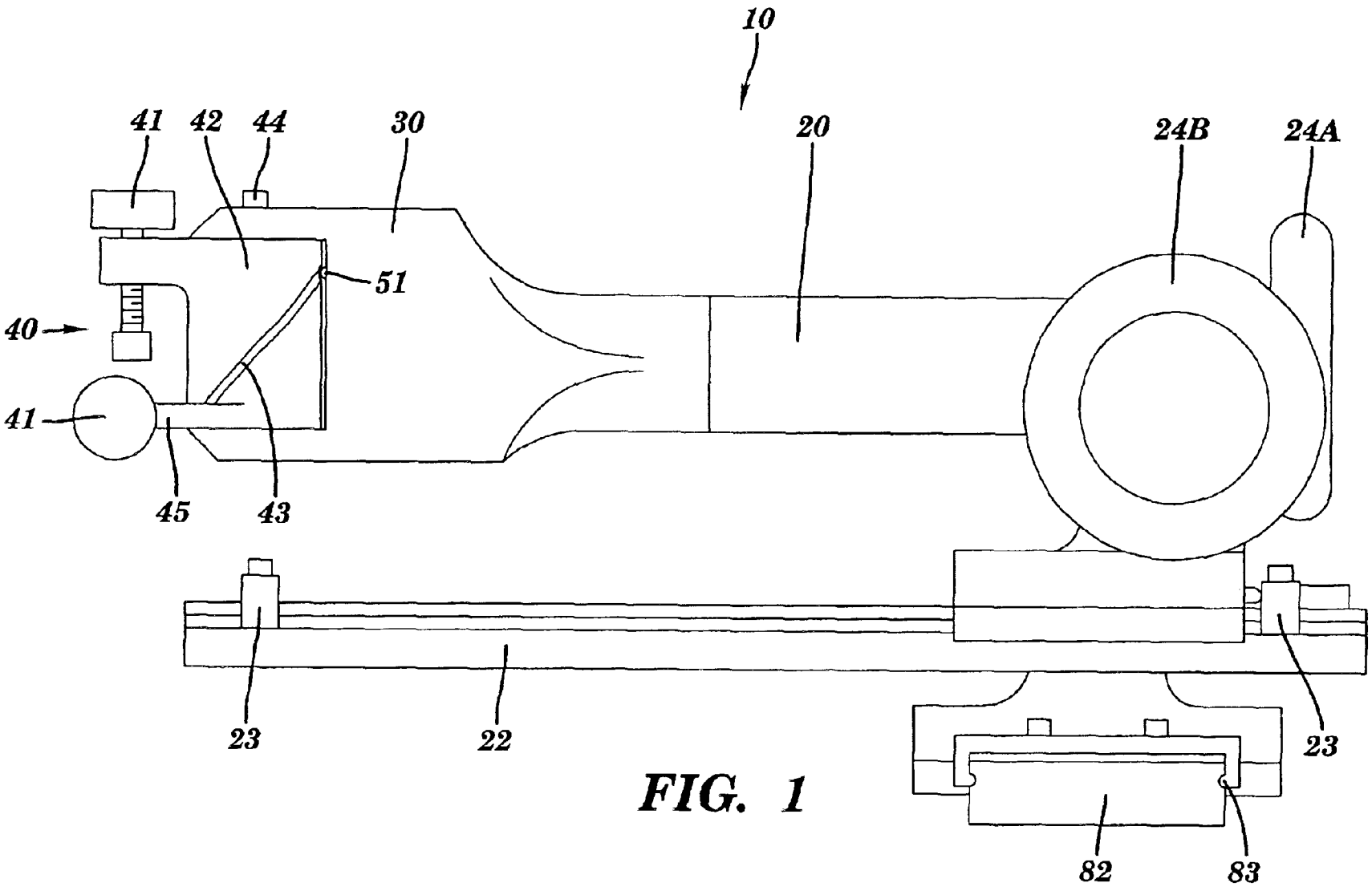
FIG. 1 depicts a front view of a material positioning and shaping apparatus, in accordance with the present invention.

FIG. 1 shows a front view of a material positioning and shaping apparatus, in accordance with the present invention. The apparatus is generally designated 10. The apparatus 10 employs a positioning system which allows the apparatus 10 to position and shape a workpiece 5 (not shown). Part of the apparatus 10 can include a material shaping device. A material shaping device is a device that either adds, deletes, or some combination thereof, to the original material resulting in a change in the original material. Examples of the material shaping device include a gem cutter, a grinding wheel, a lens grinder, etc. The apparatus 10 may have a positioning head attached to a base, of some sort. The positioning system may be made up of at least two sections, in this embodiment a head piece 30 and a stage 40. An embodiment shown in FIG. 1 is made up of a main mount 20 which has a head piece 30 rotatably attached thereto. Rotatably attached to the headpiece 30 is the stage 40. Typically the workpiece 5, be it a gem, scissors, lens, or other material that may require shaping is placed on the apparatus 10. The workpiece 5 is held in place on the workpiece platform 45 of the stage 40. The workpiece 5 can be held in place by a plurality of clamps 41. There is a plurality of dials 24 (i.e., 24A, 24B) which activate various pinions (not shown). The pinions, in turn, communicate with various ball detents which, in turn, communicate with various depressions. Thus, the ball i the ball-detent system of the invention is a type of movement means for causing rotational positioning of the positioning head. The movement of the various ball detents, likewise, cause movement in both the various depressions, and with the various pieces on which the depressions reside on, or are connected to. Thus, the positioning head can rotate, or move, along a path due to the depressions on part of the positioning head. For example, the front ball 51 of the front ball detent 50 rides in various depressions 43. The depressions 43 are on the front detent 42, which is part of the stage 40. Upon movement of the front ball 51, the stage 40 rotates and the workpiece 5 attached thereon. The stage 40 rotates about a pin 44 that extends from the top of the main mount 30 through the axial center of the front detent 42 through to the bottom portion of the main mount 30. The main mount 20 can either be moveably, slidably, rotatably attached, or fixed to additional support means. In the embodiment shown, the main mount 20 is attached to a slide 22, with two adjustable slide stops 23 located at either end of the slide 22. The slide 22 is further attached to a second slide 82, with corresponding adjustable slide stops 83. In the embodiment shown, the first slide 22 is normal to the second slide 82. Alternatively the main mount 20 can be fixed to a base (not shown) or to additional slides and other support systems. As the following will show, the plurality of precise ball and detent systems on the apparatus 10 will allow both precise general positioning of a workpiece 5 and for the precise symmetrical positioning of the workpiece 5 about various axes of rotation on th apparatus 10.

Figure 2:
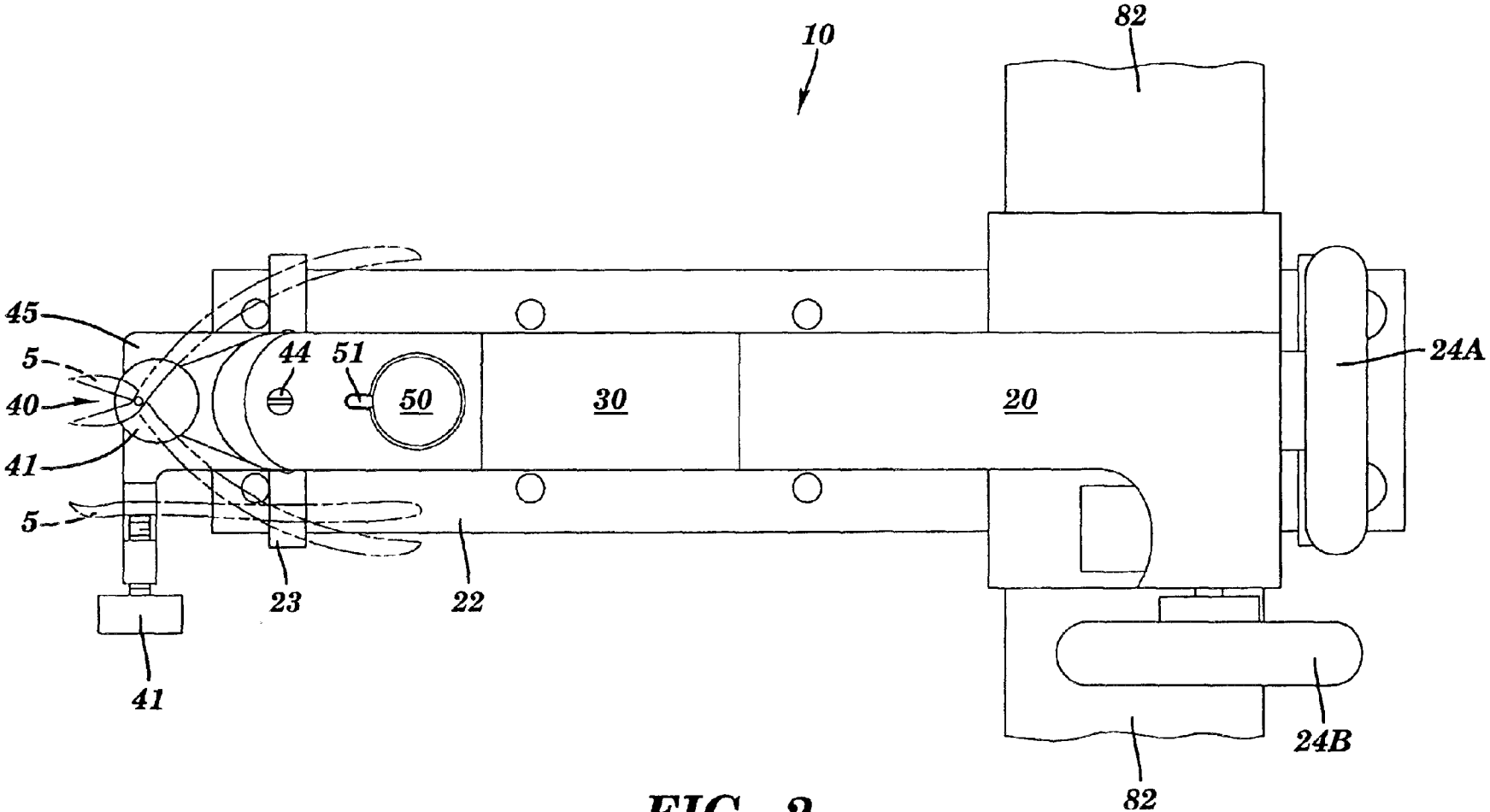
FIG. 2 depicts a top view of a material positioning and shaping apparatus, in accordance with the present invention.

As shown in FIG. 2, a top view of the apparatus 10 according to the present invention, the stage 40 has a workpiece platform 45 on which various workpieces 5 (shown in phantom) are placed for shaping, sharpening, grinding, etc. Typically, the workpiece 5 can be held in place on the workpiece platform 45 of the stage 40, via a clamp 41. There may be a plurality of clamps 41 thereby allowing positioning of the workpiece 5 in multiple directions. As shown in FIG. 2 a cuticle cutter can be the workpiece 5. As the two phantom views of the cuticle cutter 5 show, the cuticle cutter 5 can be placed partially open and held via the top clamp 41. The cuticle cutter 5 can also be placed on its side and held in place via the side clamp 41. The placement can depend on which edge of the cuticle cutter 5 elects to sharpen or grind. On the inboard side of the stage 40 is a front detent 42 (not shown). The front detent 42 which is circular or elliptical in section has a bore through which a threaded pin 44 is inserted to rotatably attach the stage 40 to the trunnions on the head piece 30, thereby allowing rotation of the front detent 42 about its longitudinal axis while it is held within the head piece 30. The front ball detent 50 has a front ball 51, or other tracking means, residing thereon. The front ball 51 is spring-biased so as to assert pressure against the front detent 42. The front ball 51 will ride or track in various depressions 43 residing on the exterior of the front detent 42. The front ball detent 50 is located within a bore in the head piece 30. Although the cross section of the front ball detent 50 is shown as circular, virtually any cross sectional shape may be employed. A section of the front ball detent 50 can be omitted to provide a substantially flat surface that acts as a rack 52. The surface of the rack 52 is knurled to provide improved purchase for the operatively attached front pinion 53.

Figure 3:
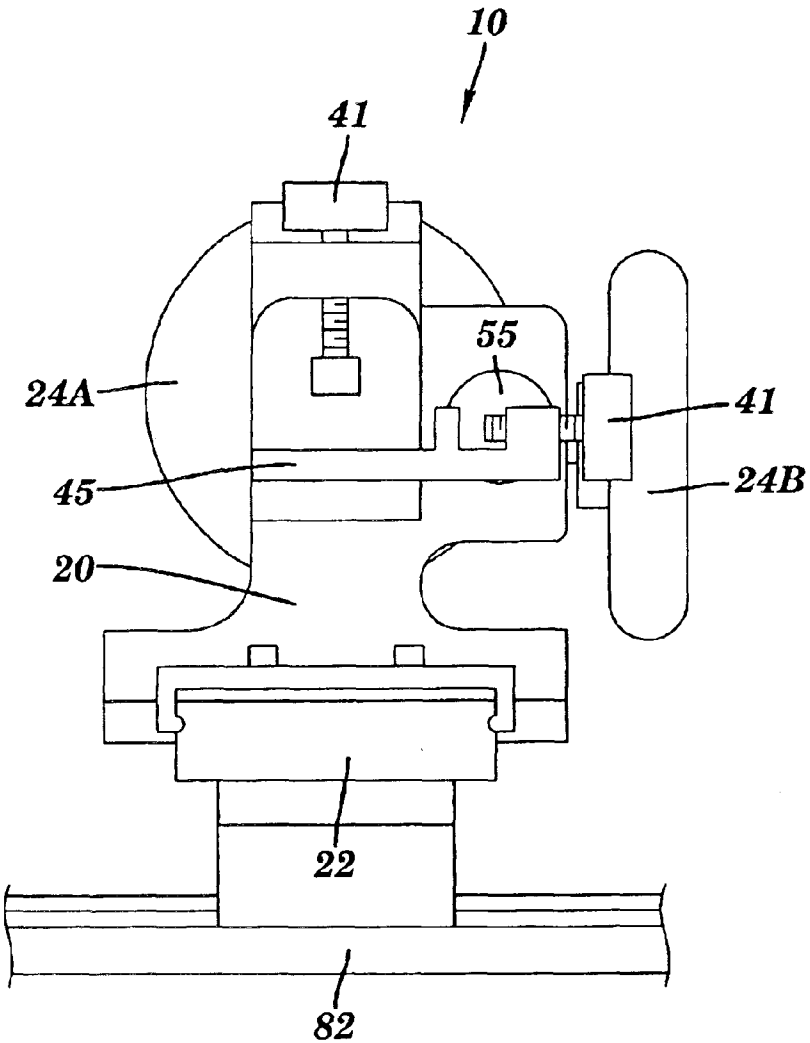
FIG. 3 depicts a front end view of a material positioning and shaping apparatus, in accordance with the present invention.

FIG. 3 depicts a front end view of a material positioning and shaping apparatus 10, in accordance with the present invention. The rear ball detent 55 can been seen beyond the workpiece platform 45 and clamp 41. The rear ball detent 55 is moved by rotation of dial 24B.

Figure 4:
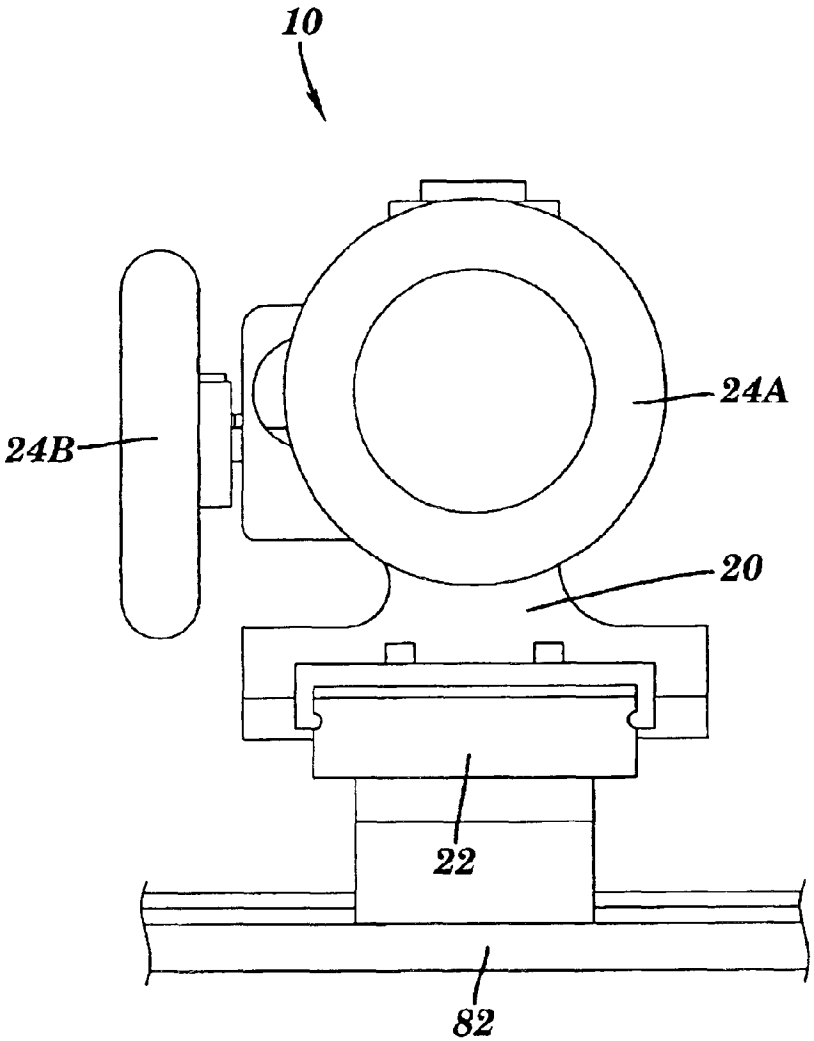
FIG. 4 depicts a rear end view of a material positioning and shaping apparatus, in accordance with the present invention.

FIG. 4 depicts a rear end view of a material positioning and shaping apparatus 10, in accordance with the present invention. Both dials 24A, 24B rotate pinions (not shown). Rotation of dial 24A rotates a pinion, which ultimately causes rotation of the stage 40 and workpiece 5 thereon. Rotation of dial 24B rotates a pinion, which ultimately causes rotation of the head piece 30.

Figure 5:
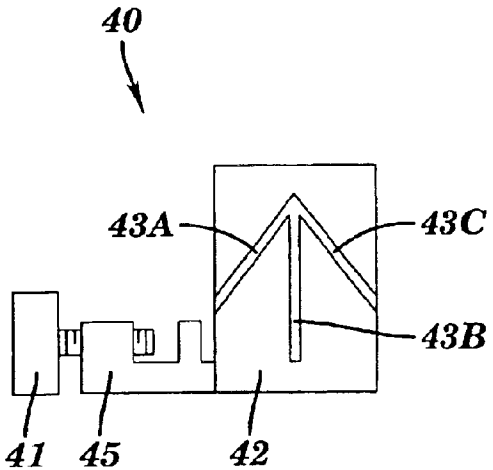
FIG. 5 depicts a side view of a front detent of a material positioning and shaping apparatus, in accordance with the present invention.

FIG. 5, a side view of the stage 40 taken from the 'in-board' side of the stage, shows one configuration of the depressions 43 on the front detent 42. There may be a plurality of depressions 43 (e.g., 43A, 43B, 43C). As shown, a center depression 43B is offset and parallel to the axis of rotation of the front detent 42. Symmetrical to the center depression 43B are two helical depressions 43A, 43C. The helical depressions 43A, 43C are helical about the axis of rotation of the front detent 42. The depressions 43 can be of a plurality of lengths (e.g., long lines, short slots, dimples, holes, etc.) and patterns (e.g., helical, straight, jagged, etc.). In cross section, the depressions 43 can be a channel, a groove, semi-circular, individual dimples, or other configuration. The patterns and length of the depressions 43 determine the path along which portions of the apparatus 10 will be rotatably positioned. Similarly, there may be a plurality of depressions 43 at various angles about the center depression 43B. Further, the depressions 43 can be either symmetrical or assymetrical about the center depression 43B. The depressions 43 can have either a constant or variable slope. Ultimately, the configuration of the depression 43 may dictate the path of rotation in which the front detent 42, the stage 40, and ultimately the workpiece 5 thereon, takes. Because the work piece platform 45 and front detent 42 are fixed to each other, rotation of the front detent 42 causes similar rotation of the work platform 45, and vice versa. The stage 40, work platform 45, and front detent 42 are typically one fixed unit that rotates in unison.

Figure 6:
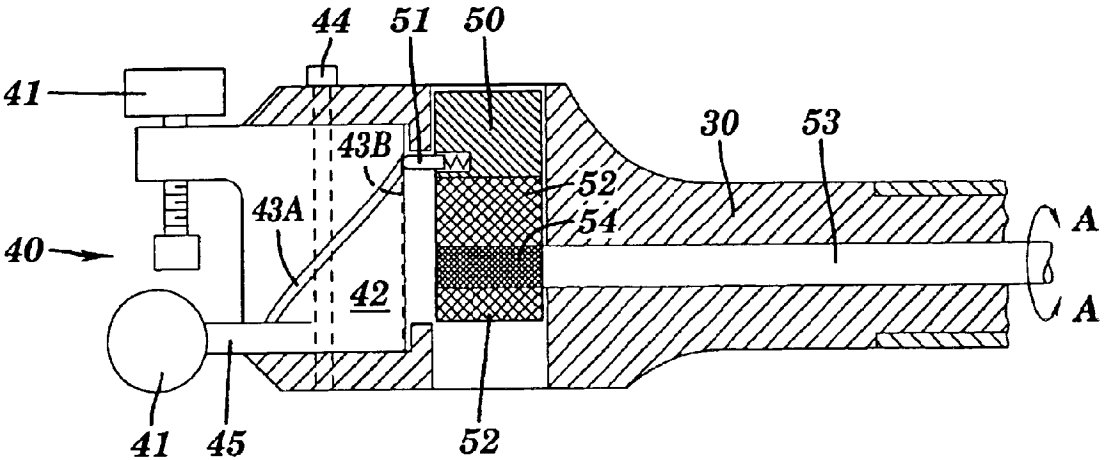
FIG. 6 depicts a sectional view of a portion of a material positioning and shaping apparatus, in accordance with the present invention.

FIG. 6 depicts a side sectional view of the front portion of the apparatus 10. Rotation of dial 24A causes rotation of a front pinion 53, as indicated by rotational arrow "A". Rotation of the front pinion 53 can be made by manual or automated means. At the other end of the front pinion 53 is a knurled surface 54 similar to the knurled surface of the rack 52 on the front ball detent 50. The knurled surface 54 is rotatably attached to the rack 52 of the front ball detent 50. Thus, rotation of the front pinion 52 results in transverse movement of the front all detent 50 within a bore of the head piece 30. A spring-biased front ball 51 on the front ball detent 50 rides in the track of various depressions 43 on the front detent 42. The transverse movement of the front ball detent 50 and front ball 50, attached thereto, then causes rotational movement in the front detent 42 about the pin 44.

Figure 7:
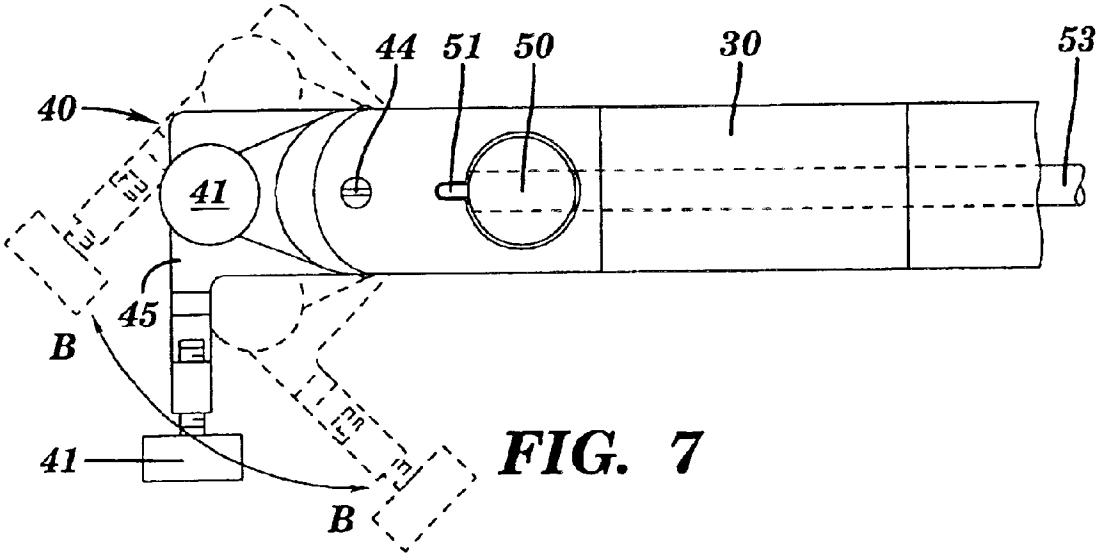
FIG. 7 depicts a top view of a portion of a material positioning and shaping apparatus, in accordance with the present invention.

FIG. 7 depicts a top view of a portion of the apparatus 10. If the front ball 51 is riding in either of the helical depressions 43A, 43C, in lieu of the center depressions 43B, then the workpiece 5 will be moved off the center axis of symmetry, as shown in directional arrow, "B". The operator then can take hold of, and rotate the stage 40 so that the front ball 51 overcomes its placement in the first helical depression 43A, 43C in which it resides. The operator then rotates the stage 40 so that the front ball 51 passes the center depression 43B and ultimately rides in the second helical depression, 43C, 43A. This rotation of the stage 40 allows for perfectly symmetrical rotation about the center axis of both the stage 40 and workpiece 5, if originally centered properly on the work platform 45, as indicated by directional arrow, "B". This symmetrical movement allows for symmetrical shaping of materials, such as, the precise sharpening of tools or faceting of gems.

Figure 10:
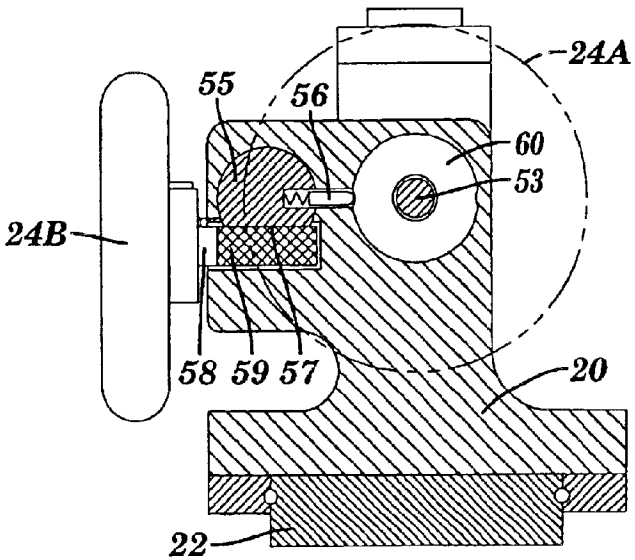
FIG. 10 depicts a rear sectional view of a main mount portion of a material positioning and shaping apparatus, in accordance with the present invention.
Figure 8:
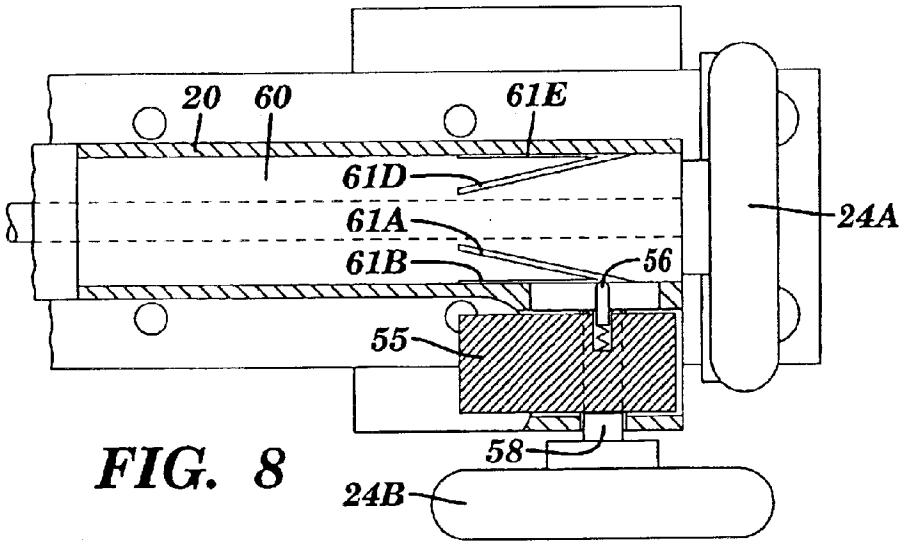
FIG. 8 depicts a top sectional view of a main mount portion of a material positioning and shaping apparatus, in accordance with the present invention.
Figure 9:
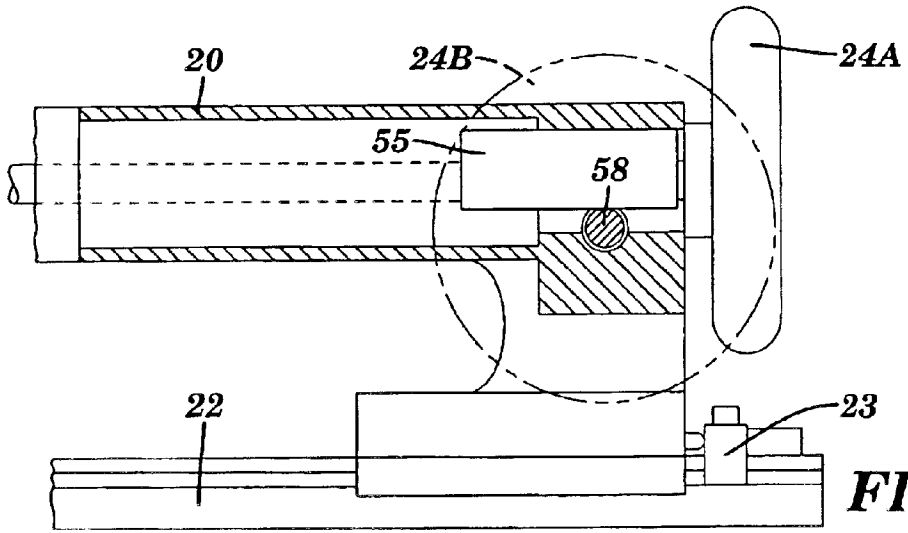
FIG. 9 depicts a side sectional view of a main mount portion of a material positioning and shaping apparatus, in accordance with the present invention.

FIG. 8 depicts a top sectional view of the rear portion of the apparatus 10. A central bore of the main mount 20 houses a rear detent 60 and the front pinion 53. The front pinion 53 is connected to the front ball detent 50. Similar to the front detent 42 system, the rear detent 60 system utilizes a rear dial 24B. Rotation of the rear dial 24B causes the rear pinion 58 to likewise rotate. The end of the rear pinion 58 has a knurled surface 59 (See FIG. 10) which engages with a rack 57 of the rear ball detent 55. Imbedded in the rear ball detent 55 is a spring-biased rear ball 56. Thus, rotation of the rear dial 24B and rear pinion 58 results in transverse movement of the rear ball detent 55 and the rear ball 56, attached thereto. This rear detent 60 allows for at least one additional degree of freedom for the stage 40. Similarly, the transverse movement of the rear ball detent 55 causes the rear ball 56 to ride in the various depression 61 residing on the exterior of the rear detent 60.

Figure 11:
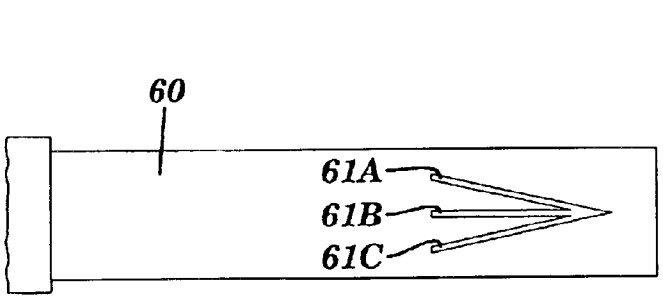
FIG. 11 depicts a side view of a rear detent of a material positioning and shaping apparatus, in accordance with the present invention.

As FIG. 11 indicates, the rear detent 60 can have a plurality of depressions 61, thereon. The shaft of the front pinion 53 acts as a rotation pin for the rear detent 60. On one side of the rear detent 60 there are three depressions 61A, 61B, 61C. A centering depression 61B is centered between two helical depressions 61A, 61C. The opposite side of the rear detent 60 can have a similar configuration of depressions 61D, 61E, 61F, wherein the centering depressions 61E is centered between two helical depressions 61D, 61F. The rear detent 60 is fixed to the head piece 30 so that rotation of the rear detent 60 results in rotation of the head piece 30. Depending on which depression 61 the rear ball 56 rides in determines the path of rotation of the rear detent 60 and head piece 30. For example, if the rear ball 56 is riding in the first helical depression 61A, the path of the rear detent 60, head piece 30 will be a rotation about the longitudinal axis of the rear detent 60. The operator can then rotate the head piece 30 so that the rear ball 56 rides out of the first helical depression 61A. The head piece 30 can then be rotated so that the rear ball 56 passes the centering depression 61B and ultimately rests in the second helical depression 61C. This rotation of the head piece 30 allows for symmetrical material shaping of a workpiece 5 in a second axis of rotation (i.e., the longitudinal axis of the rear detent 60). The second set of depressions 61D, 61E, 61F on the opposite side of the rear detent 60 allows for precise rotation of the headpiece 30, stage 40, and the workpiece 5 on another set of paths. Because the rear detent 60 can rotate a full 360° about its axis of rotation, the full exterior face of the rear detent 60 can be utilized for depression paths or detent points 61. As with the front detent 42, the helical paths 61 can either symmetrical or assymmetrical with respect to the centering depression paths (i.e., 61B, 61E). Similarly, the angle of the helical depressions (e.g., 61A, 61C, 61D, 61F) can either constant or variable. As with the front detent 42, the rear detent 60 could also have a configuration similar to that in FIG. 12 and FIG. 13 utilizing detent points 46.

Figure 12:
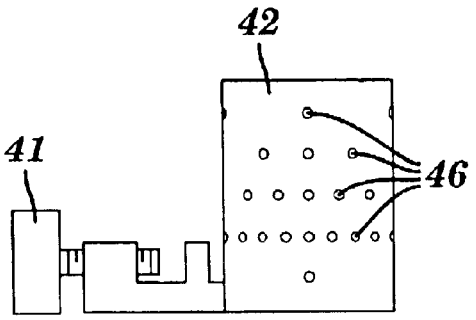
FIG. 12 depicts a side view of a front detent of a material positioning and shaping apparatus, in accordance with the present invention.
Figure 13:
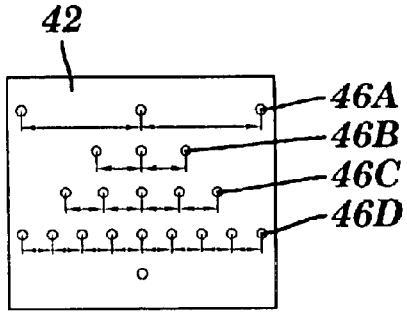
FIG. 13 depicts a side view of a "unrolled" front detent pattern of a material positioning and shaping apparatus, in accordance with the present invention.

FIG. 12 depicts another embodiment with a view similar to that of FIG. 5 (i.e., inboard side view of front detent 42). In this embodiment the front detent 42 has a plurality of detent points 46 in lieu of depression paths 43. The detents points 46 are configured so that there are several rows of detents points 46 longitudinally surrounding the exterior of the front detent 42. Each row of detents points 46 can have a different quantity of detent points 46. FIG. 13 depicts essentially the same view as in FIG. 12 except, in which, the front detent 42 has been "unrolled" for clarity purposes. For example, the first row of detent points 46A could be three detent points 46 where two of the detent points 46 are equidistant from the center detent point 46. The next row of detent points 46B, moving longitudinally down the front detent 42, has three detent points 46, whereas the two outer detent points 46 are much closer to the center detent point 46 than in the first row of detent points 46A. The third row of detent points 46C moving down the front detent 42 shows five detent points 46 each placed symmetrically about the center detent point 46. Similarly, the next row of detent points 46D can have another quantity of detent points 46 spaced about the circumference of the front detent 42. The front detent 42 thus can have a limitless number of rows of detents points 46 of successive quantities of detent points 46 in each row. The center column of detent points 46 can act as a tracking column for a ball 51 so that the operator can move the ball 51 from row to row via this centering column of detent points 46. In another embodiment, the spacing of the various detent points 46 around the circumference of the front detent 42 need not be uniform or symmetrical.

Figure 14:
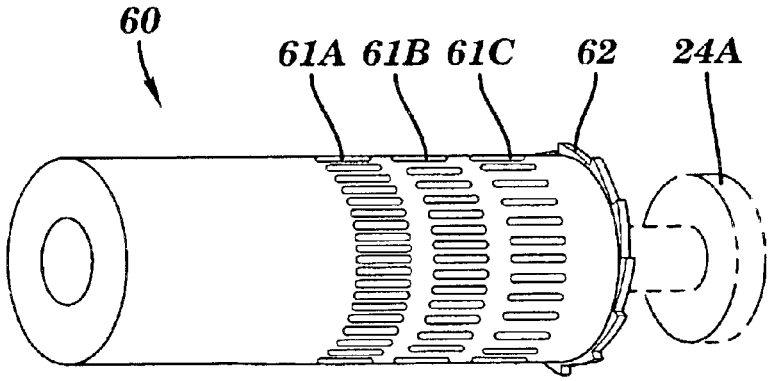
FIG. 14 depicts of a perspective view of an alternative embodiment of a rear detent of a material positioning and shaping apparatus, in accordance with the present invention.

FIG. 14 depicts a perspective view of a rear detent 60 in another embodiment of the apparatus 10. In lieu of the helical depression paths 61 shown in FIGS. 8 and 11, a plurality of depressions 61 (e.g., 61A, 61B, 61C, etc.) in the shape of slots are located on the outer circumference face of the rear detent 60. The various series of detent depressions slots (i.e., 61A, 61B, 61C, etc.) can have different quantities of depression slots 61 in the various series surrounding the circumference of the rear detent 60. Thus, for example if the rear ball 56 is engaged with the first depression 61A series, there will be a greater quantity of depression slots 61 than if the rear ball 56 is engaged with the second depression 61B series. The quantity of depression slots 61 surrounding the rear detent 60 determines the quantity of discrete rotational movements that the rear detent 60, head piece 30, workpiece platform 45, and workpiece 5 thereon can make in one full rotation of the rear detent 60. In addition to a dial 24A at the end of the rear detent 60 there can also be a ratchet wheel 62.

Figure 15:
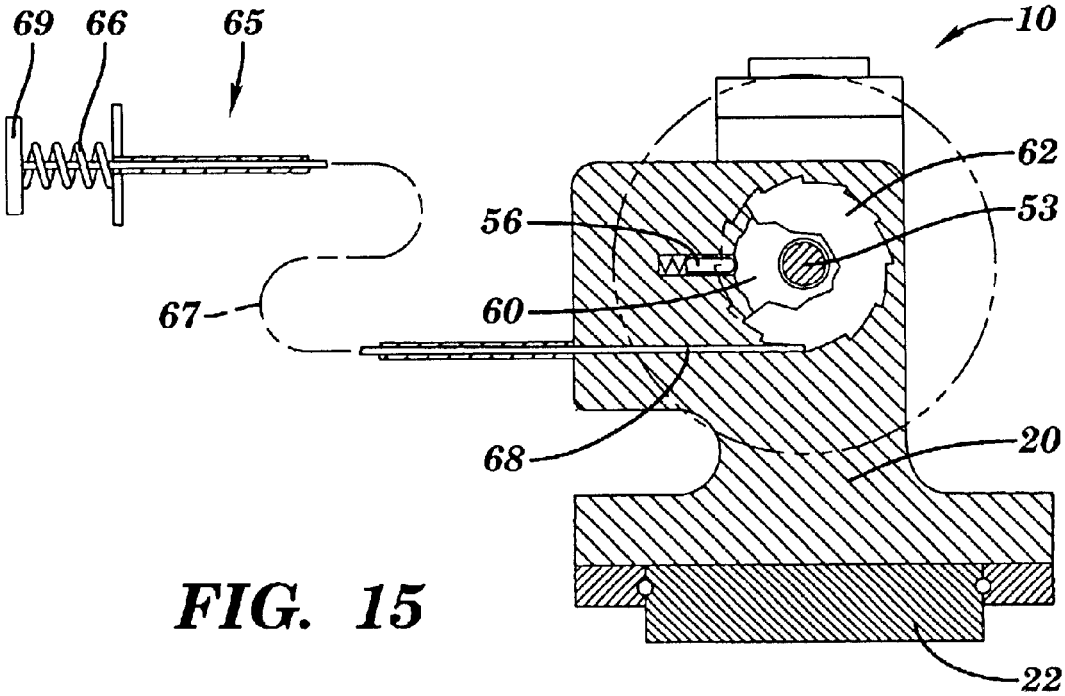
FIG. 15 depicts a rear sectional view of an alternative embodiment of a material positioning and shaping apparatus, in accordance with the present invention.

An embodiment of the apparatus 10 has an indexable means for rotational positioning of the rear detent 60 and the head piece 30, attached thereto. The indexable means allows for known, precise discrete movement of the position apparatus 10. As FIG. 15 shows, the indexable means in this embodiment is a pawl and ratchet wheel system. A plunger mechanism 65 which utilizes a pawl 68 which is operatively attached to the ratchet wheel 62. At one end of the plunger mechanism 65 is a thumbpad 69 with spring 66 and cable 65 attached thereto. The pawl 68 is attached to the opposite end of the cable 65. Thus, the operator can press the thumbpad 69 which causes the pawl 68 to forward the ratchet wheel 62. Depending on which of the series of depression slots 61 is engaged by the rear ball 56 determines how much the rear detent 60 rotationally advances per each pressing of the thumbpad 69.

Figure 16:
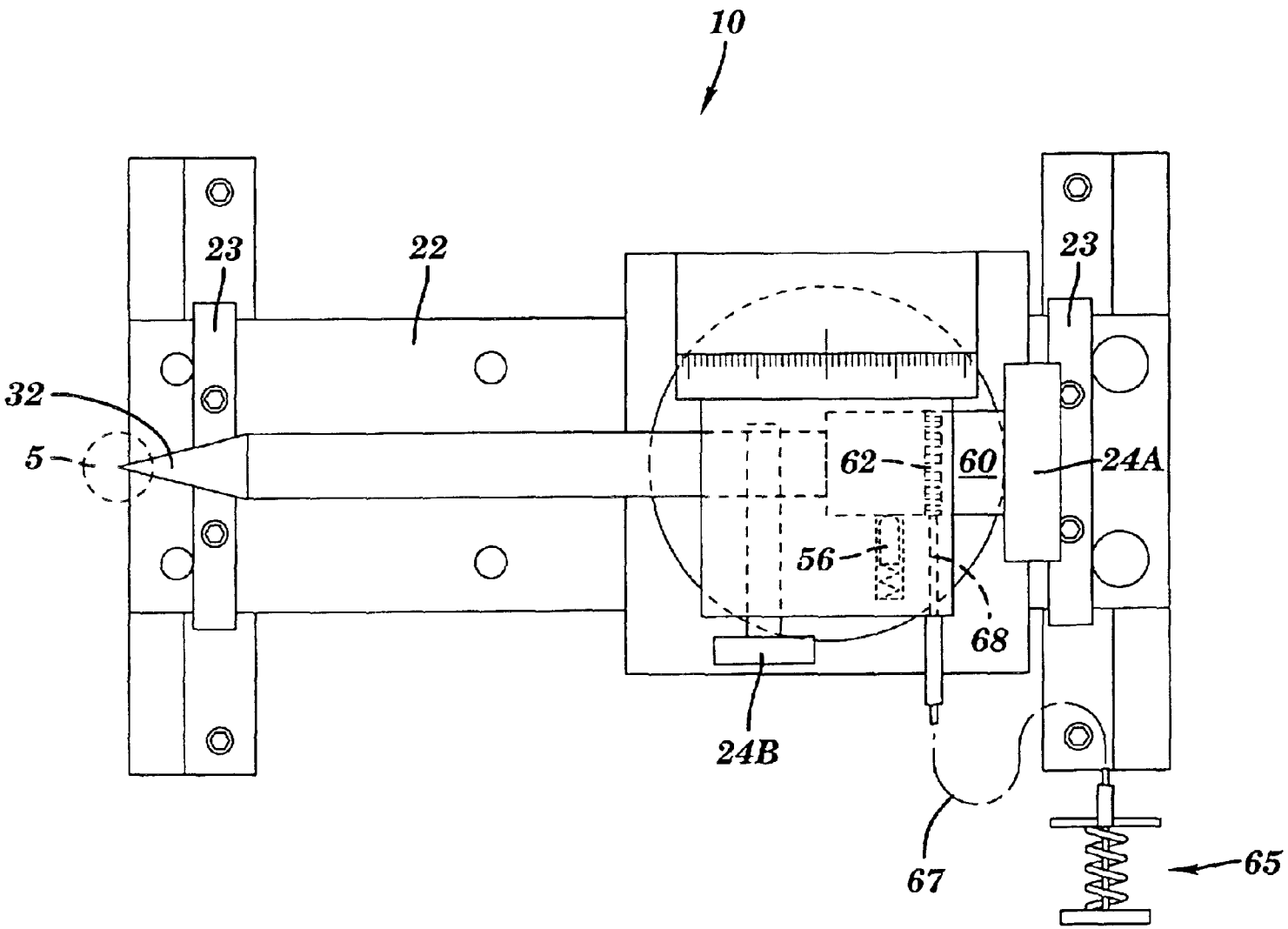
FIG. 16 depicts a top view of an alternative embodiment of a material positioning and shaping apparatus, in accordance with the present invention.
Figure 17:
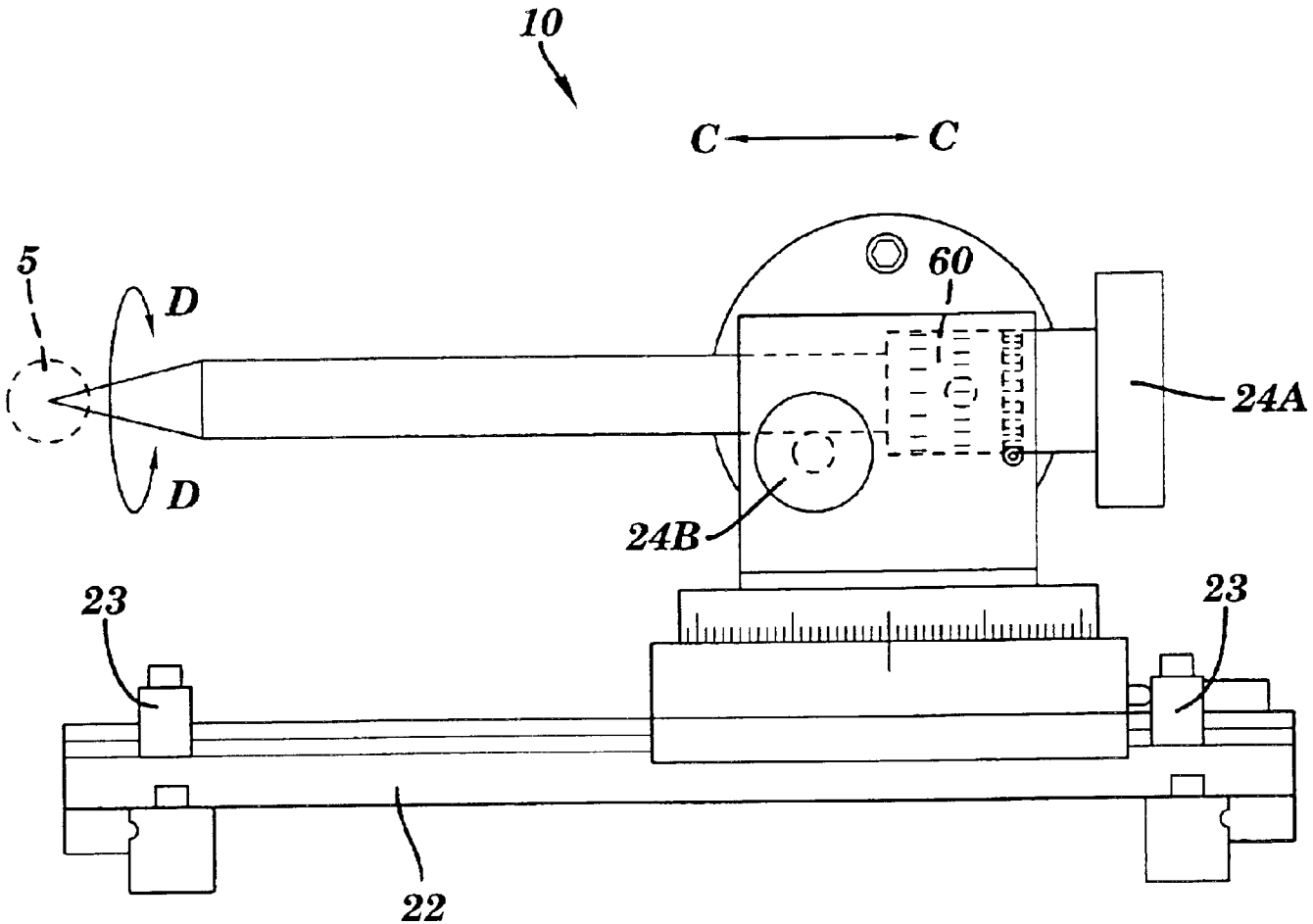
FIG. 17 depicts a front view of an alternative embodiment of a material positioning and shaping apparatus, in accordance with the present invention.
Figure 18:
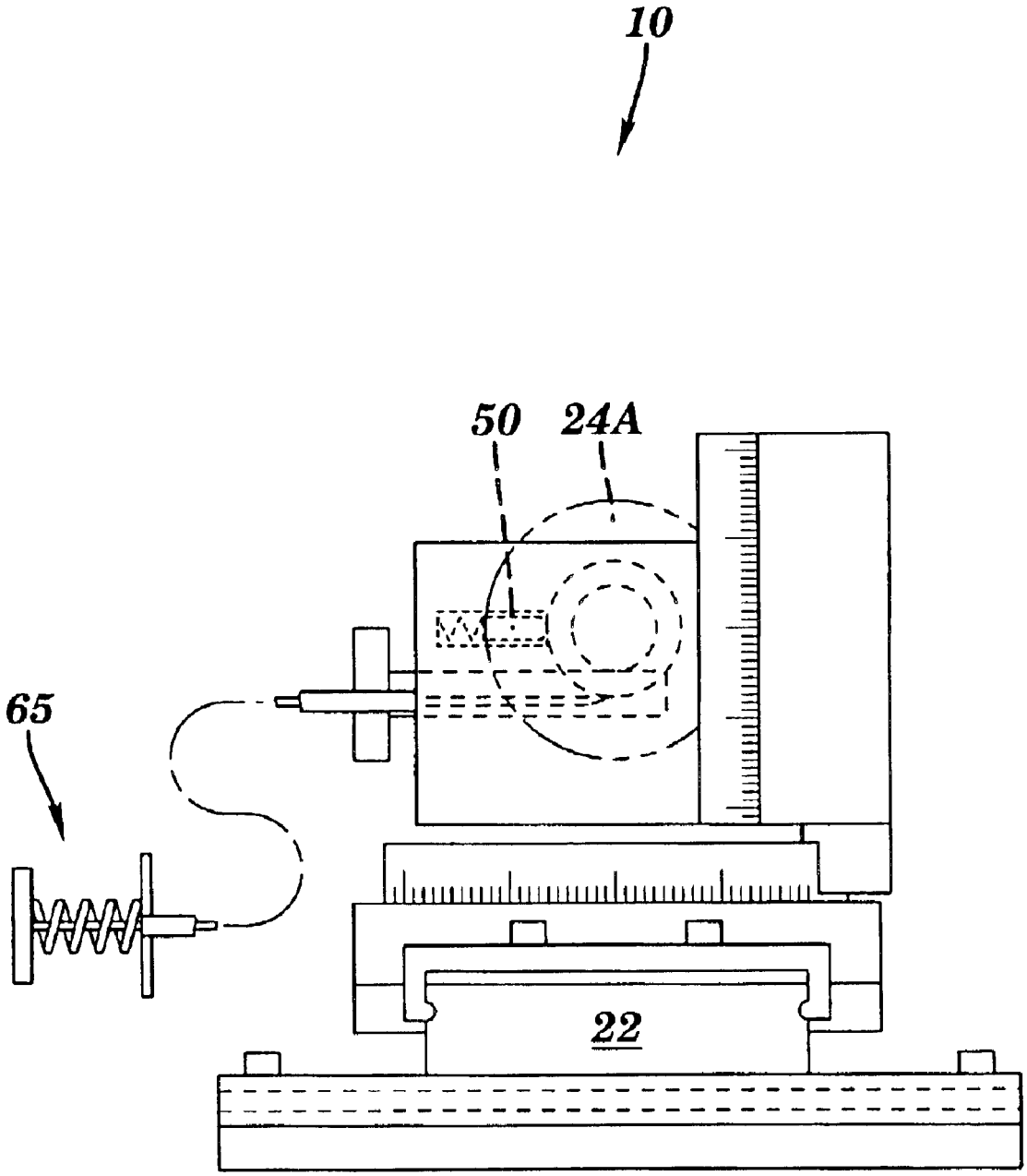
FIG. 18 depicts an end view of an alternative embodiment of a material positioning and shaping apparatus, in accordance with the present invention.

FIGS. 16–18 depicts various views of another embodiment of the apparatus 10. In this embodiment the workpiece 5, which might be a gemstone requiring cutting, grinding, or polishing is connected to a dop 32. The dop 32, in turn, has a rack (not shown) on which an extension of the dial 24B acts as a pinion to engage with the rack on the dop 32 so that the dop 32 and attached rear detent 60 can together move laterally, as shown by directional arrow "C" in FIG. 17. This lateral movement allows the rear ball 56 to engage in the various series of depression slots 61. As mentioned above, depending on which series of depression slots 61 the rear ball 56 is engaged with, determines the amount of rotation of the workpiece 5 per each pressing of the thumbpad 69. The use of the dial 24A or the plunger mechanism 65 with the pawl 68 and ratchet wheel 62 allow the sequential controlled rotation of the dop 32 and the workpiece 5 attached thereto, as shown by directional arrow "D" in FIG. 17.

Figure 19:
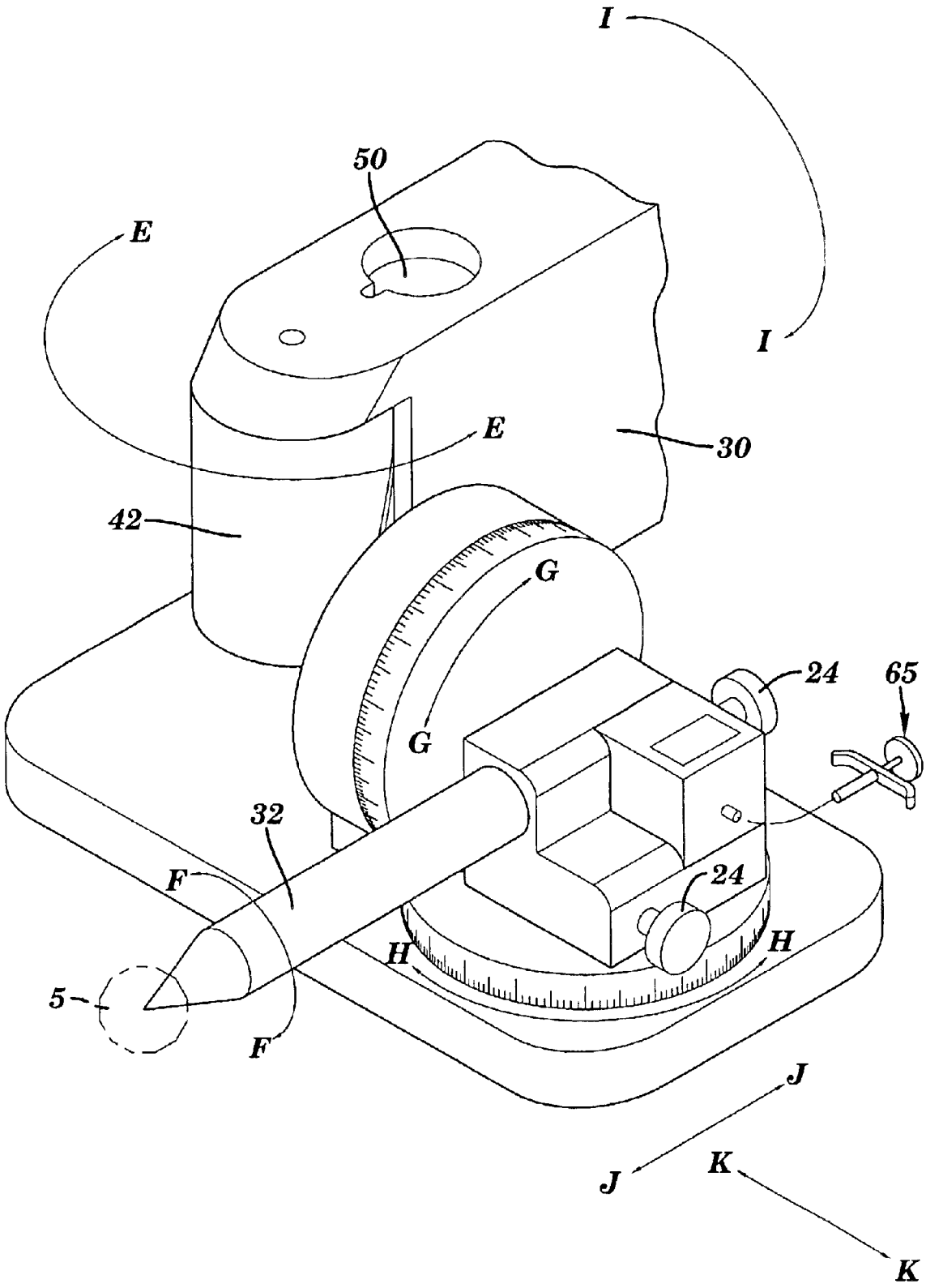
FIG. 19 depicts a front perspective view of a portion of an alternative embodiment of a material positioning and shaping apparatus, in accordance with the present invention.

FIG. 19 depicts a top perspective view of the front portion of another embodiment of the apparatus 10 according to the present invention. A portion of the head piece 30 is shown. The front ball detent 50 is shown which is operationally attached to the front detent 42. In lieu of clamps 41 attached to the workpiece platform 45 as in some of the previously mentioned embodiments, a series of parts is attached to the workpiece platform 45. These series of parts provide additional degrees of freedom to the apparatus 10. Directional arrows "E" and "I" indicate the rotation to the front detent 42 and head piece 30 respectively. These rotations are provided by rotation of dials 24 or rotational plunger 65, as discussed above. In this embodiment a gemstone 5 is held by a dop 32. The dop 32 is connected to a housing which as a plurality of dials 24. A plunger mechanism 65 is attached to the housing. As mentioned in previous embodiments, depending on which depression slot 61 is engaged, pressing of the plunger mechanism 65 causes discrete rotation of the dop 32, and the workpiece 5 thereon, as indicated by rotational arrow "F". The housing, with the dop 32 and workpiece 5 thereon can additionally be placed on two rotation gauges which allow for two additional degrees of freedom. The rotation of these two gauges is shown by rotational arrows "G" and "H". Although not depicted in FIG. 19, the apparatus 10 may be further attached to two slides 22, 82 which, similar to previously mentioned embodiments (See e.g., FIGS. 1–4), allow for movement in the "X" and "Y" directions, as indicated by directional arrows "J" and "K". Thus, this embodiment will allow for at least four degrees of freedom. Shown in the figure are seven degrees of freedom. Additional degrees of freedom can be provided for in the apparatus 10.

Another embodiment of the apparatus 10 according to the present invention can be used for grinding of various materials. In this embodiment (not shown), the main mount 20 is attached to a plurality of slides 22. The first slide 22 allows sliding movement in one direction. The first slide 22 is similarly attached to a second slide 22 thereby allowing sliding movement of the apparatus 10 in a second direction. The two slides could be normal to each other, thus allowing full movement in a "X–Y" coordinate system. The apparatus 10 could similarly be attached to rotation means, thereby allowing rotation of the stage 40 and workpiece 5 about any of the three principal axis, "X", "Y", and "Z". The slides 22 are further attached to a base. The base has a motor means which, through a pulley, can operate a series of material shaping devices (e.g., grinding wheels, buffing wheels, etc.). Thus, in this embodiment, various tools that may require sharpening can be held by the clamps 41 on the workpiece platform 45 for precise positioning and sharpening in any position.

In operation, the apparatus 10 can provide uniform, precise, and symmetrical shaping of the workpiece 5. For example a set of cuticle cutters can be the workpiece 5 that is placed on the workpiece platform 45. The workpiece 5 is fixed on the workpiece platform 45 via a clamp 41. The cuticle cutter 5 can be set open symmetrically about the front detent 42 by placing a standard hexagonal nut on the workpiece platform 45 between the cuticle cutter handles and the outboard side of the front detent 42 (See FIG. 2). By using the series of slides 22 the workpiece 5 can be moved so as to be adjacent to one of the plurality of grinding wheels. The user can rotate the dial 24A thereby causing the stage 40, front detent 42, workpiece platform 45, and the cuticle cutters 5 thereon to rotate so that one of the cuticle cutters' blade edges is parallel to one of the grinding wheels. During the grinding of this first edge on the first blade of the cuticle cutter 5, the front ball 51 will be residing in the path of one of the two helical depression paths 43A, 43C on the front detent 42 due to the angle of the cuticle cutter blade. When the operator has completed grinding the first edge on the first blade of the cuticle cutter 5, the operator can move the main mount 20 on the series of slides 22 so that the cuticle cutter is temporarily distanced from the grinding wheels. The operator can take hold of, and rotate the stage 40 so that the front ball 51 overcomes the first helical detent path 45A, 45C in which the front ball 51 resides and then rotate the stage 40 sufficiently so that the front ball 51 eventually resides in the second helical detent path 45C, 45A. This step, results in the stage 40, front detent 42, workpiece platform 45, and workpiece 5 thereon to rotate about an longitudinal axis of rotation so that the second position of the workpiece 5 is exactly symmetrical about the centering detent path 43B with the first position of the workpiece 5.

Alternative embodiments allow for the shaping of various materials in addition to sharpening tools. In additional to a work piece platform 45 and clamp 41 embodiment as aforementioned, other material holding systems can be employed. These include a dop or collet to facet gem stones or to grinding lenses and the like.

Further features in some embodiments include an indicator (not shown), which can either be visual or aural. The indicator displays the detent location of the apparatus 10. In the case of the visual indicator, the indicator could be a digital readout, or an optical window, or other device. The operator is able to determine, for example, the particular facet on the gemstone 5 that is being shaped, cut, or polished. Further, the operator can determine how many total facets are being shaped (i.e., cut, ground, polished, etc.) from the indicator. This helps the operator, in particular, on very complicated shaping projects to avoid losing track of where in the project the operator currently is using the apparatus 10. For example, if the operator elected to cut a 7-sided gemstone 5, after installing the gemstone 5 onto the dop 32, the operator could adjust laterally the dop 32, via the rack and pinion means. Then the rear detent 60 is adjusted to the desired row of detent slots 61 that has 7 points surrounding the detent 60. The readout would then read "7-sided" or "7" or "1 of 7" or "1/7" or similar notation. Upon completing the cutting or faceting of the first face of the gemstone 5, the operator then either operates the plunger mechanism 65 or rotates a hand dial 24A one "click" on the ball 56 and rear detent 60 system. The rear detent 60, dop 32, and gemstone 5, attached thereto, would then rotate, in this example, an additional one seventh of the circumference of the dop 32 and gemstone 5. The readout would then read "2 of 7" or "2/7" or similar notation.

Although several embodiments discussed involve a ball and depression type of arrangement, there are other alternative embodiments possible. For example, instead of a male (e.g, ball 51, 56) element being located on the various ball detents (e.g., 50, 55) and a female (e.g., depression 43, 61) element being located on the various detents (42, 60), the arrangement can be reversed. For example, instead of a ball (51, 56) being on the ball detent (e.g., 50, 55), the ball detent 50, 55 could have a female-type follower. Similarly, instead of a depression (43, 61) being on a detent (e.g., 42, 60), the detent 42, 60 could have a male-type guide. Thus, the detent 42, 60 may have a guide and the ball detent 50, 55 may have a follower. The relative position of the follower with respect to the guide, in part, determines the positioning of the various sections of the apparatus 10. The guide can be a depression 43, 61. All an alternative way to describe this embodiment is that the guide also, instead of being an absence of material in the case of a depression 43, 61, can be an addition of material (i.e., a male type guide) on the surface of the detent 42, 60. Similarly, the follower, instead of being an addition of material in the case of a ball 51, 56, can be an absence of material (i.e., a female type follower) on the surface of the ball detent 50, 55. The guide is operatively attached to the follower.

Another embodiment of the apparatus 10 allows for the guides or depressions to reside on a first detent piece. This first detent piece can be square, rectangular, or other shape. This first detent piece resides in a slide, or some sort. In this embodiment this first detent piece is moved (e.g., rotated, laterally moved, etc.) by the operator's actions. The operator's actions could be rotating a dial, operating a motor, etc. For example, this first detent piece could be slid. A tracking follower (e.g., ball, pin, etc.) can be attached to a second piece in which the workpiece 5 is operatively attached. The tracking follower is operatively attached to the guides (i.e., depression, detent, etc.). Thus, when the operator slides the first detent piece, by virtue of the follower on the second piece being operatively attached to the guide(s) on the first piece, will allow for the second piece, and workpiece 5 thereon, to move in an accurate predetermined path.

Another embodiment of the apparatus 10 uses other material handling devices to handle the workpiece 5. Aside from a workpiece platform 45 and plurality of clamps 41 or a dop 32, a drill, a collet, a stage, a clamping means, or other holding means can be utilized to handle the workpiece 5. The clamping means can be a vise, clamp 41, or similar device.

Another embodiment is a gemstone dop 32 transfer station (not sown) is made possible for the copying of facets of an existing gemstone 5 on to another gemstone 5. By mating two adjacent apparatuses 10 each using dops 32, with the plunger mechanism 65, along with a system of lockscrews, the facets of one gemstone 5 can be copied to a second gemstone 5. Each apparatus 10 could typically be both mated to the first gemstone 5 via their respective dops 32. A second gemstone 5 would be attached to one of the apparatuses 10. Thus, two gemstones 5 can be made identical via this system of apparatuses 10.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. An Apparatus for positioning a workpiece comprising:

a rack, wherein said rack is configured for translational movement:

a ball of a first ball-detent system, wherein said ball is attached to said rack;

a stage, wherein said stage is configured for rotational movement;

at least one detent groove of said first ball-detent system, wherein said at least one detent groove is attached to said stage; and wherein translational movement of said rack caused by rotation of a pinion upon said rack causes rotational movement of said stage via a cooperation of said ball moving within said at least one detent groove.

2. An apparatus as in claim 1, wherein the at least one detent is a plurality of detents.

3. An apparatus as in claim 2, wherein the plurality of detents are symmetrically located about a line parallel to an axis of rotation of said stage.

4. An apparatus as in claim 3, wherein the plurality of symmetrically located detents are arranged in a plurality of rows in an axial direction of said stage.

5. An apparatus as in claim 2, further including an indexable means for indexing of the rotational movement of said stage.

6. An apparatus as in claim 5, wherein said stage includes at least one tool selected from the group consisting of a dop, a collet, a drill, and a holding means.

7. An apparatus as in claim 5, wherein the indexable means is a pawl and ratchet wheel system.

8. An apparatus as in claim 5, wherein the indexable means further includes an indicator which indicates a detent location.

9. An apparatus as in claim 8, wherein the indicator is a visual indicator.

10. An apparatus as in claim 1, wherein the at least one detent is selected from the group consisting of a groove, a channel, a dimple, a slot, and a hole.

11. An apparatus as in claim 1, wherein the at least one detent is helical about an axis of rotation of said stage.

12. An apparatus as in claim 11, wherein the at least one detent further includes a plurality of detents that are helical about the axis of rotation of said stage.

13. An apparatus as in claim 12, further comprising:

a non-helical detent located between said plurality of helical detents, further configured for cooperation with said ball.

14. An apparatus as in claim 13, wherein said plurality of helical detents are symmetrical about said non-helical detent.

15. An apparatus as in claim 12, wherein a slope of at least one of said plurality of helical detents is non-constant.

16. An apparatus as in claim 12, further comprising a centering detent on said stage, wherein said centering detent is non-helical and parallel to the axis of rotation of said stage.

17. An apparatus as in claim 16, wherein said centering detent is between said plurality of detents.

18. An apparatus as in claim 17, wherein said plurality of helical detents are symmetrical about said centering detent.

19. An apparatus as in claim 18, wherein said plurality of helical detents include a first detent and a second detent, further wherein said plurality of helical detents and said centering detent are configured so that said stage rotates so that said at least one ball escapes said first helical detent and reenters said second helical detent, wherein said rotation thereby causes said stage to rotate symmetrically about said centering detent.

20. An apparatus as in claim 1, wherein an axis of translation of said rack is parallel with an axis of rotation of said stage.

21. An apparatus as in claim 1, wherein said stage further includes at least one tool selected from the group consisting of a dop, a collet, and a drill.

22. An apparatus as in claim 1, wherein said stage further includes a clamping means.

23. An apparatus as in claim 1, further including a second ball-detent system, including a ball that cooperates with at least one detent, wherein a translational movement of said ball causes a second rotational movement of said stage, wherein said second rotational movement is different that said rotational movement caused by said first ball-detent system.

24. An apparatus as in claim 23, wherein an axis of rotation of the stage caused by the second ball-detent system is not collinear with an axis of rotation of the stage caused by the first ball-detent system.

25. An apparatus as in claim 23, wherein said translational movement of said ball of said second ball-detent system is caused by a translation of a second rack.

26. An apparatus as in claim 23, wherein said at least detent of said second ball-detent system include helical detents.

27. An apparatus as in claim 26, wherein said helical detents of said second bell-detent system are configured so that said stage rotates so that said ball of said second ball-detent system escapes a first helical detent of said second ball-detent system and reenters a second helical detent of said second bail-detent system.

28. An apparatus as in claim 1, further including a first support means slidingly attached to the apparatus in a first direction; and a second support means slidingly attached to the first support means in a second direction.

29. An apparatus as in claim 28, wherein the second direction is normal to the first direction.

30. An apparatus as in claim 1, further comprising:

a material shaping device for engagement with the workpiece; and further wherein said first ball-detent system is configured so that said stage rotates around a first axis either via said ball moving within said at least one detent groove or via rotating said stage while said ball is not within said at least one detent groove.

31. An apparatus as in claim 30, further comprising a second ball-detent system that includes a second ball and at least one detent groove, said system configured so that a translational movement of said second ball causes a rotational movement of said stage around a second axis, said second ball-detent system is further configured so that said rotates around said second axis either via said second ball moving within said at least one detent groove or via rotating said stage while said second ball is not within said at least one detent groove of said second ball-detent system.

32. An apparatus as in claim 1, further comprising a material shaping device for engagement with the workpiece wherein the material shaping device is selected from the group consisting of a gem cutter, a grinding wheel, and a lens grinder.

33. An apparatus as in claim 1, wherein said stage includes a circular cylindrical section.

34. An apparatus as in claim 1, wherein said rack includes a circular cylindrical section.

* * * * *